United States Patent [19]

Umeda et al.

[11] Patent Number: 4,835,134

[45] Date of Patent: May 30, 1989

[54] COLOR-DEVELOPING SHEET FOR PRESSURE-SENSITIVE SHEETS

[75] Inventors: Hiroaki Umeda; Mamoru Suzuki; Akira Hasegawa; Kunio Hata, all of Tokyo, Japan

[73] Assignee: Jujo Paper Co., Ltd., Tokyo, Japan

[21] Appl. No.: 131,556

[22] Filed: Dec. 11, 1987

[30] Foreign Application Priority Data

Jan. 14, 1987 [JP] Japan ..... 62-7014

[51] Int. Cl.[4] ..... B41M 5/22

[52] U.S. Cl. ..... 503/210; 428/342; 428/914; 503/211; 503/212; 503/216; 503/217; 503/225

[58] Field of Search ..... 427/150–152; 428/914, 341, 342; 503/210–212, 216, 217, 225

[56] References Cited

U.S. PATENT DOCUMENTS 4,749,680 6/1988 Umeda et al. ..... 503/210

FOREIGN PATENT DOCUMENTS 60-159540 7/1985 Japan ..... 503/212

*Primary Examiner*—Bruce H. Hess

*Attorney, Agent, or Firm*—Koda and Androlia

[57] ABSTRACT

The color-developing sheet for pressure-sensitive recording sheets comprises a color-developing agent containing a phenolic polymer in combination with a polyvalent metal salt of carboxylated terpenephenol resin and/or a reaction product of carboxylated terpenephenol resin, aromatic carboxylic acid and polyvalent metal compound.

This color-developing sheet provides superior plasticizer resistance and less deterioration of a color-developing ability with the lapse of time.

8 Claims, No Drawings

COLOR-DEVELOPING SHEET FOR PRESSURE-SENSITIVE SHEETS

BACKGROUND OF THE INVENTION

1. Field of the Invention

This invention relates to a color-developing sheet having less deterioration of a color-developing ability with lapse of time and superior plasticizer resistance.

2. Prior Art

Pressure-sensitive recording sheets are known as carbonless copying paper. They produce a color upon the application of a mechanical or impact pressure by writing or by pounding a typewriter, thus permitting duplication of several copies. A colored image is formed by a color-developing reaction between an electron-donating colorless dye and a electron-accepting color-developing agent.

Hitherto, many kinds of electron-accepting color-developing agents are well-known. The typical color-developing agents include inorganic solid acids such as acid clay, activated clay, attapulgite (described in U.S. Pat. No. 2,712,507); substituted phenols and diphenols (described in the Japanese Patent Publication No. 9309/1985); p-substituted phenol-formaldehyde polymers (described in the Japanese Patent Publication No. 20144/1967); aromatic carboxylic acid metal salts (described in the Japanese Patent Publication Nos. 10856/1974 and 1327/1977); 2,2'-bisphenol sulfone compounds (described in the Japanese Patent Laid-Open No. 106313/1979); and so on. Among above color-developing agents, phenolic polymers, such as p-substitute phenol-aldehyde polymers, etc., are widely applied for practical use since they are produced inexpensively and provide sheets having a high image density and a superior resistance of an image under the action of light, humidity and heat.

However, the color-developing sheet containing a phenolic polymer as a color-developing agent has following defects: a color-developing rate and an end color-developing intensity deteriorate in storage (hereinafter referred to as "the deterioration of color-developing ability with the lapse of time"; the stability of colored image on the contact with oils, particularly plasticizer, (hereinafter referred to plasticizer resistance) is inferior; and the like.

SUMMARY OF THE INVENTION

An object of this invention is to provide a color-developing sheet containing a phenolic polymer as a color-developing agent which has less deterioration of a color-developing ability with the lapse of time and superior plasticizer resistance under maintaining the excellent properties of phenolic polymers.

DETAILED DESCRIPTION OF THE INVENTION

The above object may be performed by using a phenolic polymer in combination with a polyvalent metal salt of carboxylated terpenephenol resin and/or a reaction product of carboxylated terpenephenol resin, aromatic carboxylic acid and polyvalent metal compound.

As phenolic polymer of this invention, there are used phenol-aldehyde polymers known in Japanese Patent Publication No. 2014/1967, paricularly phenol novolak resins and polyvalent metal-modified phenol novolak resins.

Phenolic polymer of this invention includes, for example, p-phenylphenol-formaldehyde polymer, p-octylphenol-formaldehyde polymer, p-cumylphenol-formaldehyde polymer, p-tert.-butylphenol-formaldehyde polymer, p-nonylphenol-formaldehyde polymer, p-cyclohexylphenol-formaldehyde polymer, p-octylphenol-acetoaldehyde polymer, p-phenylphenol-acetoaldehyde polymer, p-tert.-butylphenol-acetoaldehyde polymer, and the like.

Both the polyvalent metal salt of carboxylated terpenephenol resin and the reaction product of carboxylated terpenephenol resin, aromatic carboxylic acid and polyvalent metal compound, which are used in this invention, are color-developing agents having a novel structure which were proposed by inventors. They provide a excellent light resistance in storage and a superior plasticizer resistance.

As described in the Japanese Patent Application No. 159540/1985, the carboxylated terpenephenol resin is prepared by the following process.

The addition reaction of cyclic monoterpene and phenol is carried out in petroleum-solvent in the presence of an acidic catalyst, e.g. aluminum chloride, boron trifluoride, sulfuric acid, polyphosphoric acid, to prepare a condensation product. Cyclic monoterpene used in this invention includes, for example, pinene, limonene, terpinolene, methadiene, gum-turpentine oil which contains $\alpha$-pinen as main ingredient, dipentene which contains $\alpha$-limonene as main ingredient, and the like.

Phenol used in this invention includes monophenols, for example, carbolic acid, alkyl-substituted phenols, alkoxy-substituted phenols, halogenated phenols, etc.; and polypalent phenols, for example, resorcin, catechol, etc.

Petroleum solvent used in this invention includes, for example, benzene, toluene, xylene, n-hexan, n-heptane, halogenized solvent such as dichloromethane, chloroform, trichloroethane, brombenzene, etc. The condensation product is made basic with alkaline metal, alkaline metal hydroxide, or alkaline metal carbonate. The basic condensation product is allowed to react with carbonic acid gas under high temperature (140°–180° C.) and high pressure (5–30 atm.) in an autoclave to introduce carboxy groups. (Kolbe-Schmitt's reaction).

After the completion of reaction, the solvent is removed by a distillation. Meanwhile, the product is cooled to room temperature and washed to separate out the unreactants. The resultant product is extracted with an aqueous alkaline solution. After the neutralization of extracted product, carboxylated terpenephenol resin is separated out. After filtrating and washing, a purified carboxylated terpenephenol resin is obtained.

A polyvalent metal salt of carboxylated terpenephenol resin are prepared by a method which comprises melting the carboxylated terpenephenol resin together with oxide, hydroxide, chloride, carbonate or sulfate of polyvalent metal and inorganic ammonium salt and thereby making them to react, or by a method which comprises dissolving carboxylated terpenephenol resin together with hydroxide of alkali metal in a solvent such as water, alcohol, etc., adding alcohol-soluble polyvalent metal salts thereto and thereby carring out the reaction, or by other methods.

Polyvalent metal used in this invention includes, for example, magnesium, aluminium, calcium, cadmium, titanium, zinc, nickel, cobalt, magnanese etc.

Magnesium, aluminium and zinc are preferable, and zinc is most preferable.

As previously is proposed, the reaction product of carboxylated terpenephenol resin, aromatic carboxylic acid and polyvalent metal compound is prepared either by mixing the carboxylated terpenephenol resin, the aromatic carboxylic acid and polyvalent metal compound uniformly and then causing the reaction thereof, or by mixing above two ingredients uniformly, adding the third ingredient to the mixture and causing a reaction thereof. Uniform mixing is performed by dissolving the ingredients in a solvent under stirring or by melting them under heating, and the like.

Examples for the solvent include aqueous basic solutions such as sodium hydroxide, potassium hydroxide, sodium carbonate, etc.; organic solvents such as alcohol, aceton, etc.; and the mixture thereof.

Aromatic carboxylic acid, in which carboxyl group is bonded to an aromatic ring (mono-ring or poly-rings), includes, for example, benzoic acid, p-hydroxybenzoic acid, chlorobenzoic acid, bromobenzoic acid, nitrobenzoic acid, methoxybenzoic acid, ethoxybenzoic acid, toluic acid; ethylbenzoic acid, p-n-propylbenzoic acid, p-isopropylbenzoic acid, 3-methyl-4-hydroxybenzoic acid, 3-ethyl-4-hydroxybenzoic acid, 3-methoxy-4-hydroxybenzoic acid, p-tert.-butylbenzoic acid, o-benzoylbenzoic acid, p-cyclohexylbenzoic acid, salicylic acid, 3-methyl-5-tert.-butylsalicylic acid, 3,5-ditert.-butylsalicylic acid, 5-nonylsalicylic acid, 5-cyclohexylsalicylic acid, 3-cyclohexylsalicylic acid, 3,5-diamylsalicylic acid, cresotic acid, 5-nonylsalicylic acid, 5-cumylsalicylic acid, 3-phenylsalicylic acid, 3,5-sec.-butylsalicylic acid, 2,4-dihydroxybenzoic acid, 2,5-dihydroxybenzoic acid, gallic acid, naphthoic acid, phthalic acid monobenzyl ester, phthalic acid monocyclohexyl ester, salicylosalicylic acid, 3-tert.-butyl-5-α-methylbenzylsalicylic acid, 3,5-di(α-methylbenzyl) salicylic acid, phthalic acid, terephthalic acid, isophthalic acid, diphenic acid, naphthalene dicarboxylic acid, naphtholic acid, and the like.

Among these carboxylic acids, mono-carboxylic acids are most preferable.

Polyvalent metal compound used in this invention includes, for example, oxides, halides, carbonates, sulfates, nitrates, acetates, formates, oxalates, benzoates, acetylacetonates salt, salicylates, etc. of magnesium, aluminum, cadmium, calcium, titanium, zinc, nickel, cobalt, manganese, vanadium and the like. Magnesium compounds, aluminium compounds and zinc compounds are preferable; and zinc compounds is most preferable.

The polyvalent metal salt of acarboxylated terpenephenol resin and/or the reaction product of carboxylated terpenephenol resin, aromatic carboxylic acid and polyvalent metal compound, which are used in this invention, are not otherwise limited, and are preferably at least 1 weight %, more preferably at least 30 weight % based on the phenolic polymer.

A coating solution for the color-developing agents is prepared as follows:

(1) Color-developing agents are dispersed with a dispersing agent individually, mixed together, and filler, binder, etc. are added to the mixed color-developing agents, (2) Color-developing agents are dispersed simultaneously, and filler, binder, etc. are added to the dispersed color-developing agent, or (3) Color-developing agents are mixed, dissolved by heating or in solvent, are dispersed with a dispersing agent, and filler, binder, etc. are added to the dispersed color-developing agents.

A color-developing sheet is prepared by coating the above coating solution as a single layer on a substrate uniformly. However, there may be used multi-layer coating method which comprises applying on a substrate a coating solution containing a color-developing agent, superposing thereon a coating solution containing another color-developing agent and the like.

The color-developing agent of this invention is applied to a wide range of field concerning pressure-sensitive recording sheets, for example, a middle sheet of pressure-sensitive recording sheets, a bottom sheet thereof, a single-type pressure-sensitive recording sheet by coating as laminated layer or as a mixed-state layer; a detecting agent of leuco dyestuff by dissolving this salt in organic solvent; a spot printing ink by mixing this salt with wax, etc.; a pressure-sensitive color-developing ink by encapsulating of color-developing and/or leuco dyestuff; and the like.

The color-developing sheet which contains the color-developing agent of this invention is prepared by the conventionally known method, for example:

(a) applying on a support such as paper, an aqueous coating color in which an aqueous suspension of a color-developing agent is used;

(b) adding the color-developing agent to the stuff in a paper making; and (c) coating on the surface of the support the organic solvent in which a color-developing agent is dissolved or suspended, and then drying the coated support.

The coating color is produced by mixing kaolin-clays, calcium carbonate, starch, polyvinyl alcohol and synthetic or natural latex, and then giving appropriate viscosity and coating suitability for the mixed materials. It is desirable to use 10 to 70 % by weight of the color-developing agent, based on the total solid content in the coating color. If the color-developing agent is less than 10% by weight, the sufficient results cannot be attained. If the color-developing agent is more than 70%, the surface properties of the color-developing sheet is inferior.

The coating weight is more than 0.5 g/m$^2$, preferably 1.0–10 g/m$^2$. The color-developing agent of this invention can be used for the conventionally known pressure-sensitive color-forming dye. Examples of these dyes are as follows.

Triphenylmethane leuco dyes

Crystal violet lactone, malachite green lactone, 3-dimethylamino-triphenylmethanephthalide, and the like.

Fluoran leuco dyes 3,6-dimethoxyfluoran, 3-N-cyclohexylamino-6-chlorofluoran, 3-diethylamino-6-methyl-7-chlorofluoran, 1,2-benzo-6-dimethylaminofluoran, 1,2-benzo-(2',-diethylamino)-6-diethylaminofluoran, 3-diethylamino-7-dibenzylaminofluoran, 3-diethylamino-6-methyl-7-dibenzylaminofluoran, 3-diethylamino-5-methyl-7-dibenzylaminofluoran, 3-diethylamino-7-aminofluorane, 3-diethylamino-6-methyl-7-anilinofluoran, 3-diethylamino-7-(o-acetyl)anilinofluoran, 3-diethylamino-7-piperidinofluoran, 3-diethylamino-7-pyrolidinofluoran, and the like.

Spiropyran leuco dyes spiro-[3-methylchromene-2,2'-7'-diethylamino chromene], spiro[3-methylchormene-2,2'-7'-dibenzylamino-chromene]6',8'-dichloro-l-3,3-trimethylindolino-benzospiropyran, 1,3,3-trimethyl-6'-nitrospiro(indoline)-2,2'-2'H chromene, spiro[1,3,3-trimethylindoline-2,3'-8'-bromonaphtho-[2,1-b]pyran], spiro[3-methyl-benzo(5,6-a)chromene-2,2'-7'-diethylaminochromene and the like.

Phenothiazine leuco dyes 3-diethylamino-7(N-methylanilino)-10-benzoyl-phenoxazine; 3,7-bis(dimethylamino)-10-benzoylphenothiazine, 10-(3',4',5'-trimethoxy-benzoyl)-3,7-bis-(dimethylamino)-phenothiazine, and the like.

Phthalide leuco dyes 3-4(diethylamino-2-ethoxyphenyl)-3-(1-ethyl-2-methylindol-3-yl)7-azaphthalide, and the like.

Indol leuco dyes 3,3 bis(1-octyl-2-methylindol-3-yl)phthalide, and the like.

Triphenylmethane leuco dyes

N-butyl-3[bis- 4-N-methylanilino)phenyl methyl]carbazole and the like.

Function

This invention provides superior plasticizer resistance and less deterioration of a color-developing ability with the lapse of time, which are regarded as defects of a color-developing sheet containing a phenolic polymer as a color-developing agent. The reason therefor is probably that the polyvalent metal salt of carboxylated terpenephenol resin or the reaction product of carboxylated terpenephenol resin, aromatic carboxylic acid and polyvalent metal compound provides a superior plasticizer resistance and a less deterioration of a color-developing ability with the lapse of time.

EXAMPLES

The following examples are given merely as illustrative of this invention and are not to be considered as limiting. All percentages and parts throughout the application are by weight unless otherwise indicated.

The transfer sheet coated with pressure-sensitive dye-containing microcapsules and the evaluation of the color-developing sheet under using this transfer sheet are as follows.

Preparation of a transfer sheet 90 parts of a 10% aqueous solution of an ethylene-maleic anhydride copolymer (trade mark: EMA-31, made by Monsanto Co.) and 90 parts of dilution water were mixed, and 10 parts of urea and 1 part of resorcinol were dissolved in the mixed solution. The obtained solution was adjusted to a pH-value of 3.4.

Separately, an oil mixture consisting of alkyldiphenylethane (trade mark: Hysol SAS 296, made by Nisseki chemical Co.) and diisopropylnaphthalene (trade mark: KMC-113, made by Kureha Chemical Co.) in a proportion of 1:1 was prepared.

As two core materials, (a) the oil of blue color-forming dye was prepared by dissolving 3% of crystal violet lactone (CVL) and 1% of benzoyl leuco methylene blue in the above oil mixture, and (b) the oil of black color-forming dye was prepared by dissolving 5% of 3-diethylamino-6-methyl-7-anilinofluoran, 1% of 3-diethylamino-6-methyl-7-diphenylmethylaminofluoran and 0.5% of 3-diethylamino-6-methyl-7-chlorofluoran in the above oil mixture.

180 parts of each of above dye oils were added to the above-produced aqueous solution of a pH-value having 3.4, and emulsified until an average particle size of 4.0 was obtained.

To this emulsion were added 27 parts of 37% formalin and heated to 55° C. After carrying out at encapsulation reaction at 55° C. for 2 hours, the reacted solution was adjusted to a pH-value of 7.5 by the addition of 28% aqueous ammonia solution to prepare two capsule slurries which contains pressure-sensitive dyes.

180 parts of each of the capsule slurries, 40 parts of wheat starch and 85 parts of 8% oxidized starch solution were mixed to prepare two kinds of coating solution.

These coating solutions were independently coated on a fine paper having a basis weight of 45 g/m$^2$ to obtain (a) blue color-forming transfer sheet and (b) black color-forming transfer sheet.

Evaluation of the color-developing sheet

Each of the transfer sheets (a) and (b) and a color-developing sheet are laid so that the coated surfaces of the sheets are faced with each other.

The obtained colored sheets were tested with regard to color-developing rate, end color-developing intensity and light fastness. The test results are summarized in Table 1.

(1) Color-developing rate and color-developing intensity

A CB-sheet coated with microcapsules and a color-developing sheet coated with a color-developing agent are laid so that the two coated surfaces are faced with each other. A pressure is applied to the two sheet by dot-plate roll calender to form a color. The reflectance $I_o$ of the sheet before color development, the reflectance $I_1$ of the sheet of 10 sec after color development, are measured by a Hunter Reflectmeter (manufactured by Toyo Seiki Co.; D type) using an amber filter. The color-developing rate ($J_1$) is expressed by the following equation:

$$\text{Color-developing rate } J_1 = \frac{I_0 - I_1}{I_0} \times 100\ (\%)$$

And color-developing intensity is expressed by the following equation, using the reflectance $I_2$ of the sheet of 24 hours after color development.

$$\text{Color-developing intensity } J_2 = \frac{I_0 - I_2}{I_0} \times 100\ (\%)$$

Higher values of $J_1$ and $J_2$ are preferred.

(2) Deterioration of color-developing ability with the lapse of time

A color-developing sheet is storaged for 6 months under 30° C. and 60% RH. The color-developing sheet and a transfer sheet are laid so that the two coated surfaces are faced with each other. A pressure is applied to the two sheets by dot-plate roll calender to form a color. The color-developing rate $J_3$ and the color-developing intensity $J_4$ are expressed in the same manner as in the method 1).

(3) Plasticizer-resistance

A small amount of dioctyl phthalate is coated on the colored surface of the color-developing sheet of 24 hours after color development by the method described in 1). The sheet is leaved for one hour. After measuring the reflectance $I_5$ of the sheet, the color-developing intensity $J_5$ after the test is obtained in the same manner as in the method 1). From the color-developing intensities $J_2$ and $J_5$ before and after the test, the plasticizer resistance =

$$\left(\frac{J_5}{J_2}\right) \times 100\ (\%)$$

is expressed.

Higher value means excellent plasticizer resistance of the developed image.

Example 1

60 parts of p-phenyl-phenol formaldehyde novolak resin, 40 parts of carboxylated terpenephenol resin zinc-salt (manufactured from α-pinene and carbolic acid) 3.5 parts of sodium polyacrylate and 150 parts of water were admixed and then dispersed uniformly to an average particle size of 3μ by means of a sand grinder to form a water suspension of color-developing agent.

Preparation of coating color

Using the obtained water suspension a coating color having a concentration of 30% (solid) was prepared as follows.

| | |
|---|---|
| Water suspension | 40 parts |
| Calcium carbonate | 100 parts |
| Styrene-butadiene latex (40%) | 15 parts |
| Oxidized starch | 15 parts |
| Water | 415 parts |

Preparation of color developing sheet

The resultant coating color was coated on the base sheet weighing 50 g/m$^2$ at a coating weight of 5.5 g/m$^2$, using Meyer bar.

Example 2

A water suspension of color-developing agent, a coating color and a color-developing sheet were prepared in the same manner as in Example 1 except that a reaction product of zinc chloride, salicylic acid and carboxylated terpenephenol resin (manufactured from gum turpentine and carbolic acid) instead of carboxylated terpenephenol resin zinc salt in Example 1 was used.

Example 3

40 parts of zinc-modified p-octylphenol-formaldehyde novolak resin, 55 parts of carboxylated terpenephenol resin zinc salt (manufactured from α-pinene and carbolic acid), 2.5 parts of sodium hexametaphosphate and 180 parts of water were admixed and dispersed to an average particle size of 2.5μ by means of sand grinder to form a water suspension of color-developing agent.

Using an above water suspension of color-developing agent, a coating composition and a color-developing sheet were prepared in the same manner as in Example 1.

Example 4

70 parts of zinc-modified p-octylphenol formaldehyde novolak resin, 50 parts of a reaction product of 3,5-ditert.-butylsalicylic acid, zinc benzoate and carboxylated terpenephenol resin (manufactured from limonene and carbolic acid), 3.6 parts of sodium polyacrylate and 100 parts of water were dispersed to an average particle size of 3μ by means of sand grinder to obtain a water suspension of color-developing agent.

Using the above water suspension, a color-developing sheet was prepared in the same manner as in Example 3.

Comparative Example 1

100 parts of p-phenylphenol-formaldehyde novolak resin, 2.5 parts of sodium polyacrylate and 100 parts of water are dispersed to an average particle size of 3.2μ by means of sand grinder to obtain a water suspension of color-developing agent.

A coating composition and a color-developing sheet were prepared in the same manner as in Example 1.

Comparative Example 2

A color-developing sheet was prepared in the same manner as in Comparative Example 1 except that zinc-modified p-octylphenol-formaldehyde novolak resin was used instead of p-phenylphenol-formaldehyde novolak resin.

The color-developing sheet of this invention contains a phenolic polymer in combination with a polyvalent metal salt of carboxylated terpenephenol resin and/or a reaction product of carboxylated terpenephenol resin, aromatic carboxylic acid and polyvalent metal compound. As seen in Table 1, which showed the test results of color-developing sheets in Examples and Comparative Examples, the color-developing sheet of this invention provides a less deterioration of a color developing ability with the lapse of time and a better plasticizer resistance than a color-developing sheet containing only a phenolic polymer.

TABLE 1

| | | After preparation | | After storage of 6 months | | Plasticizer |
|---|---|---|---|---|---|---|
| | Kind of transfer sheet | Color-developing rate ($J_1$) | Color-developing intensity ($J_2$) | Color-developing rate ($J_3$) | Color-developing intensity ($J_4$) | resistance after color-development ($J_5$) |
| Example 1 | A | 41.8% | 55.3% | 39.9% | 55.0% | 89.0% |
| Example 1 | B | 36.9 | 56.0 | 37.0 | 56.0 | 90.5 |
| Example 2 | A | 42.5 | 54.5 | 41.8 | 54.1 | 92.3 |
| Example 3 | A | 41.0 | 53.0 | 40.5 | 51.9 | 95.0 |
| Example 4 | A | 40.0 | 52.8 | 38.2 | 52.2 | 94.5 |
| Example 4 | B | 37.7 | 51.5 | 37.2 | 51.3 | 98.9 |
| Comparative Example 1 | A | 41.0 | 54.0 | 27.6 | 48.2 | 38.2 |

TABLE 1-continued

| | Kind of transfer sheet | After preparation Color-developing rate ($J_1$) | After preparation Color-developing intensity ($J_2$) | After storage of 6 months Color-developing rate ($J_3$) | After storage of 6 months Color-developing intensity ($J_4$) | Plasticizer resistance after color-development ($J_5$) |
|---|---|---|---|---|---|---|
| Comparative Example 1 | B | 36.5 | 55.5 | 20.5 | 50.0 | 65.0 |
| comparative Example 2 | A | 40.5 | 52.5 | 30.4 | 49.1 | 60.5 |
| comparative Example 2 | B | 35.6 | 51.1 | 18.5 | 48.5 | 78.5 |

Effects of the Invention

As explained above, the color-developing sheet of this invention provides superior plasticizer resistance and less deterioration of a color-developing ability with the lapse of time under maintaining the excellent properties of phenolic polymers, wherein the color-developing sheet containing only a phenolic polymer has a inferior plasticizer resistance and more deterioration of a color-developing ability with the lapse of time.

We claim:

1. A color-developing sheet for pressure sensitive recording sheets containing on a substrate a color-developing layer comprising as a color-developing agent a phenolic polymer in combination with at least one substance selected from the group consisting of a polyvalent metal salt of carboxylated terpenephenol resin and a reaction product of carboxylated terpenephenol resin, aromatic carboxylic acid and polyvalent metal compound, said phenolic polymer being at least one member selected from the group consisting of p-phenylphenol-formaldehyde polymer, p-octylphenol-formaldehyde polymer, p-cumylphenol-formaldehyde polymer, p-tert.-butylphenol-formaldehyde polymer, p-nonylphenol-formaldehyde polymer, p-cyclohyexylphenol-formaldehyde polymer, p-octylphenol-acetoaldehyde polymer, p-phenylphenol-acetoaldehyde polymer and p-tert.-butylphenol-acetoaldehyde polymer.

2. The color-developing sheet according to claim 1, wherein said polyvalent metal is zinc.

3. The color-developing sheet according to claim 1, wherein said substance is at least 1% by weight, based on said phenolic polymer.

4. The color-developing sheet according to claim 3, wherein said substance is at least 30% by weight, based on said phenolic polymer.

5. The color-developing sheet according to claim 1, wherein said color-developing agent is contained in a range of 10–70% by weight, based on the total solid content in said color-developing layer.

6. The color-developing sheet according to claim 1, wherein the weight of said color-developing layer is 1.0–10.0 g/m$^2$.

7. The color-developing sheet according to claim 1, wherein said color-developing agent is used in combination with at least one dye selected from the group consisting of triphenyl-methane leuco dyes, fluoran leuco dyes, spiropyran leuco dyes, phenothiazine leuco dyes, phthalide leuco dyes, indol leuco dyes and triphenylmethane leuco dyes.

8. The color-developing sheet according to claim 1, wherein said aromatic carboxylic acid is aromatic monocarboxylic acid.

* * * * *